US012578153B2

(12) United States Patent
Rasmussen

(10) Patent No.: US 12,578,153 B2
(45) Date of Patent: Mar. 17, 2026

(54) ATTACHMENT MEANS AND HEAT TRANSFER PLATE

(71) Applicant: ALFA LAVAL CORPORATE AB, Lund (SE)

(72) Inventor: Jenny Rasmussen, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 83 days.

(21) Appl. No.: 18/555,392

(22) PCT Filed: Apr. 19, 2022

(86) PCT No.: PCT/EP2022/060222

§ 371 (c)(1),
(2) Date: Oct. 13, 2023

(87) PCT Pub. No.: WO2022/233563

PCT Pub. Date: Nov. 10, 2022

(65) Prior Publication Data

US 2024/0200878 A1 Jun. 20, 2024

(30) Foreign Application Priority Data

May 4, 2021 (EP) ..... 21171915

(51) Int. Cl.
*F28F 3/10* (2006.01)

(52) U.S. Cl.
CPC ..... *F28F 3/10* (2013.01); *F28F 2230/00* (2013.01)

(58) Field of Classification Search
CPC ..... F28F 3/10
See application file for complete search history.

(56) References Cited

U.S. PATENT DOCUMENTS 4,635,715 A 1/1987 Andersson
10,451,361 B2 10/2019 Rasmussen
(Continued)

FOREIGN PATENT DOCUMENTS

CN 202304546 U 7/2012
CN 203011215 U * 6/2013
(Continued)

OTHER PUBLICATIONS

Office Action (Notice of Reasons for Rejection) issued on Jan. 14, 2025, in corresponding Japanese Patent Application No. 2023-567208 and English translation of the Office Action. (13 pages).
(Continued)

*Primary Examiner* — Eric S Ruppert
(74) *Attorney, Agent, or Firm* — BUCHANAN INGERSOLL & ROONEY PC

(57) ABSTRACT

To fasten a gasket to a heat transfer plate, an attachment device includes a connection member, a first finger, a second finger and a bridge. A first connection part of the connection member is arranged to engage with the gasket and a second connection part of the connection member engages with the bridge. A connection part of the first finger engages with the bridge and a connection part of the second finger engages with the bridge. The first and second fingers are arranged to extend from the bridge towards the gasket. The connection member extends between the first and second fingers. The connection member includes a first portion with a first width and a second portion with a second width. The second portion is arranged closer to the bridge than the first portion, and the second width is smaller than the first width.

19 Claims, 5 Drawing Sheets

(56) References Cited

U.S. PATENT DOCUMENTS

| | | | |
|---|---|---|---|
| 2019/0003783 | A1 | 1/2019 | Hedberg |
| 2019/0219341 | A1 | 7/2019 | Petersen et al. |

FOREIGN PATENT DOCUMENTS

| | | | | |
|---|---|---|---|---|
| CN | 205580263 | U | | 9/2016 |
| CN | 207556343 | U | * | 6/2018 |
| EP | 0762071 | A1 | | 3/1997 |
| EP | 2886998 | A1 | | 6/2015 |
| EP | 3640576 | A1 | | 4/2020 |
| JP | S60-501568 | A | | 9/1985 |
| JP | H08-271178 | A | | 10/1996 |
| JP | 2003-502611 | A | | 1/2003 |
| JP | 2012-512382 | A | | 5/2012 |
| JP | 2017-500531 | A | | 1/2017 |
| JP | 2018-537651 | A | | 12/2018 |
| WO | 85/00052 | A1 | | 1/1985 |
| WO | 00/77468 | A1 | | 12/2000 |
| WO | 2010071551 | A2 | | 6/2010 |
| WO | 2010092556 | A1 | | 8/2010 |
| WO | 2019/224537 | A1 | | 11/2019 |

OTHER PUBLICATIONS

Office Action (Substantive Examination Report) issued on Oct. 21, 2024, in corresponding Saudi Arabian Patent Application No. 523451385 and English translation of the Office Action. (8 pages).

International Search Report (PCT/ISA/210) and Written Opinion (PCT/ISA/237) mailed on Aug. 30, 2022 by the European Patent Office as the International Searching Authority for International Application No. PCT/EP2022/060222. (10 pages).

Office Action issued on Aug. 8, 2025, by the Korean Intellectual Property Office in Korean Patent Application No. 10-2023-7041138 and an English translation of the Action. (9 pages).

* cited by examiner

ATTACHMENT MEANS AND HEAT TRANSFER PLATE

TECHNICAL FIELD

The invention relates to an attachment means for fastening a gasket to a heat transfer plate, and to a heat transfer plate arranged to cooperate with such an attachment means.

BACKGROUND ART

Plate heat exchangers, PHEs, typically comprises two end plates in between which a number of heat transfer plates are arranged in an aligned manner, i.e. in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates in gasket grooves pressed in the heat transfer plates. Typically, the gasket grooves extend partially along and adjacent edges of the heat transfer plates. The end plates, and therefore the heat transfer plates, are pressed towards each other by some kind of tightening means, whereby the gaskets seal between the heat transfer plates. Parallel flow channels, defined by the gaskets, are formed between the heat transfer plates, one channel between each pair of adjacent heat transfer plates. Two fluids of initially different temperatures, which are fed to/from the PHE through inlets/outlets, may flow alternately through every second channel for transferring heat from one fluid to the other, which fluids enter/exit the channels through inlet/outlet portholes in the heat transfer plates communicating with the inlets/outlets of the PHE. In order for the channels not to leak it is naturally essential that the gaskets are properly positioned between the plates.

When the plate heat exchanger is closed, the gaskets are squeezed between the plates and thereby securely held in place. However, when the gaskets are not squeezed between the plates, such as when the plate heat exchanger is assembled or open for maintenance, some kind of means for fixing the gaskets correctly to the plates are desirable. It is known to use some kind of adhesive means, such as glue or tape, for fixing the gaskets to the plates. However, attaching the gaskets by adhesive, and replacing gaskets fastened by adhesive, may be relatively time-consuming and therefore expensive. Further, adhesive may negatively affect the gaskets and their sealing capacity. Also mechanical gasket fixing solutions are previously known, for example through applicant's own U.S. Pat. No. 4,635,715. This document discloses different embodiments of gaskets comprising projections for securing the gaskets to heat transfer plates. The gaskets described herein may provide relatively unreliable fastening to the heat transfer plates in that the engagement between the projections and the heat transfer plates is relatively weak with a risk of the projections "sliding off" the heat transfer plate.

SUMMARY

An object of the present invention is to provide an attachment means for fastening a gasket to a heat transfer plate, and a heat transfer plate arranged to engage with such an attachment means, that provides a more reliable gasket fastening as compared to prior art. The basic concept of the invention is construct the attachment means and the heat transfer plate such that they "inter-lock" when they engage with each other properly.

The attachment means and the heat transfer plate are defined in the appended claims and discussed below.

An attachment means according to the present invention is arranged to engage with an edge portion of a heat transfer plate for fastening a gasket to a first side of the heat transfer plate. It comprises a connection member, a first finger, a second finger and a bridge. A first connection part of the connection member is arranged to engage with the gasket, while a second connection part of the connection member engages with the bridge. A connection part of the first finger and a connection part of the second finger engage which the bridge. The first and second fingers are arranged to extend from the bridge towards the gasket, and the connection member extends between the first and second fingers. The attachment means is characterized in that the connection member comprises a first portion with a first width and a second portion with a second width. The second portion is arranged closer to the bridge than the first portion, and the second width is smaller than the first width. A width of the connection member may be measured parallel to a length extension of the bridge.

The first and second widths of the connection member referred to above may be varying or constant.

The connection member may have a longitudinal symmetry axis which may extend perpendicular to, and through a center of, the bridge.

The first finger may lack a longitudinal symmetry axis.

Thus, the attachment means according to the present invention has a connection member with a width that is varying along at least a part of a length of the connection member, so as to achieve a connection member adapted to mechanically "self-lock", in at least one direction, in a heat transfer plate having a suitable design. This "self-lock" may firmly fix the attachment means to the heat transfer plate and prevent displacement of the attachment means in relation to the heat transfer plate, especially in a direction perpendicular to the width extension of the connection member and parallel to an extension plane of the heat transfer plate.

The attachment means may be so designed that the second portion of the connection member comprises the second connection part of the connection member. Then, the second portion of the connection member will border on the bridge.

The second portion of the connection member may be have many different shapes. According to one embodiment of the invention it is tapered in a direction towards the bridge along at least part of its length. Such a design may enable a smooth transition between the first and second portions of the connection member and, thus, a tractable and durable attachment means.

The attachment means may be such that the connection member further comprises a third portion with a third width, wherein the first portion of the connection member is arranged between the second and third portions of the connection member, and the third width is smaller than the first width. This configuration may enable an attachment means with a connection member adapted to mechanically "self-lock", in at least two opposite directions, in a heat transfer plate having a suitable design, and an even more firm fixing of the attachment means to the heat transfer plate.

The attachment means may be so designed that the third portion of the connection member comprises the first connection part of the connection member. Then, the third portion of the connection member will be arranged to border on the gasket.

The third portion of the connection member may be have many different shapes. According to one embodiment of the invention it is tapered in a direction away from the bridge along at least part of its length. Such a design may enable a smooth transition between the first and third portions of the connection member and, thus, a tractable and durable attachment means.

The attachment means may be such that the first finger comprises a first portion with a first width and a second portion with a second width. The second portion may be arranged closer to the bridge than the first portion, and the first width may be smaller than the second width. A width of the first finger may be measured parallel to the length extension of the bridge. Such a design may render the attachment means more easy to bring into proper engagement with the heat transfer plate. Further, such a design may render the first finger more flexible which may result in a stronger engagement between the attachment means and the heat transfer plate. Also, such a design may result in an adaptation of the shape of the first finger to the shape of the connection member which, in turn, may enable a compact attachment means.

The first and second widths of the first finger referred to above may be varying or constant.

The attachment means may be so designed that the second portion of the first finger comprises the connection part of the first finger. Then, the second portion of the first finger will border on the bridge.

The second portion of the first finger may be have many different shapes. According to one embodiment of the invention it is tapered in a direction away from the bridge along at least part of its length. Such a design may enable a smooth transition between the first and second portions of the first finger and, thus, a tractable and durable attachment means.

The attachment means may be so designed that an outer longitudinal side of the first finger, i.e. the side facing away from the connection member, is essentially straight and extends essentially perpendicular in relation to the length extension of the bridge. Such a design may result in an adaptation of the shape of the first finger to the shape of connection member which, in turn, may enable a compact attachment means.

The attachment means may be such that a thickness of the bridge is larger than a thickness of the first finger. Such a design may make the first finger more flexible than the bridge. In turn, this may render the attachment means more easy to bring into proper engagement with the heat transfer plate and result in a stronger engagement between the attachment means and the heat transfer plate.

Naturally, the second finger of the attachment means may be designed like the first finger of the attachment means.

A heat transfer plate according to the present invention comprises, on a first side thereof, a gasket groove extending along an edge of the heat transfer plate. An edge portion of the heat transfer plate extends between the edge and the gasket groove, and it is corrugated so as to comprise alternately arranged ridges and valleys as seen from the first side of the heat transfer plate. The edge portion comprises a gasket fastening area arranged to engage with an attachment means as defined above for fastening a gasket in the gasket groove. The gasket fastening area comprises a first one of the valleys and first and second ones of the ridges, the first and second ridges being arranged on opposite sides of the first valley. The heat transfer plate is characterized in that the first valley comprises a first portion with a first width and a second portion with a second width. The second portion is arranged closer to the edge than the first portion, and the second width is smaller than the first width. A width of the ridges and valleys may be measured parallel to a length extension of the gasket groove.

The first valley may have a longitudinal symmetry axis which may extend perpendicular to the edge.

The first ridge may lack a longitudinal symmetry axis.

The heat transfer plate may be so designed that the second portion of the first valley is tapered in a direction towards the edge along at least part of its length.

The first valley may further comprise a third portion with a third width, the first portion of the first valley being arranged between the second and third portions of the first valley, and the third width being smaller than the first width.

The third portion of the first valley may be tapered in a direction away from the edge along at least a part of its length.

The first ridge may comprise a first portion with a first width and a second portion with a second width, the second portion being arranged closer to the edge than the first portion, and the first width being smaller than the second width.

The second portion of the first ridge may be tapered in a direction away from the edge along at least part of its length.

An outer longitudinal side of the first ridge may be essentially straight and extend essentially perpendicular in relation to the edge of the heat transfer plate.

The first valley may be at least partly open towards the gasket groove. By this is meant that the first valley, or more particularly the space defined by the first valley, is in communication with the gasket groove, or more particularly the space defined by the gasket groove. Such a design may allow for the connection member of the attachment means to extend within planes defining an extension of the heat transfer plate so as to not effect a sealing between an overlying heat transfer plate and the gasket. The first and second ridges may be closed towards, or separated from, the gasket groove. By this is meant that the first and second ridges, or more particularly the space defined by the first and second ridges, is not in communication with the gasket groove, or more particularly the space defined by the gasket groove. Such a design may allow complete gasket support at the first and second ridges.

The heat transfer plate and the attachment means according to the invention are adapted to be used together, and the design of the heat transfer plate is adapted to the design of the attachment means, and vice versa. Thus, the above different embodiments of the heat transfer plate according to the invention correspond to the above different embodiments of the attachment means according to the invention. Accordingly, the advantages of the above different embodiments of the attachment means are transferable to the above different embodiments of the heat transfer plate. Naturally, these advantages appear first when the heat transfer plate and the attachment means cooperate with each other.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
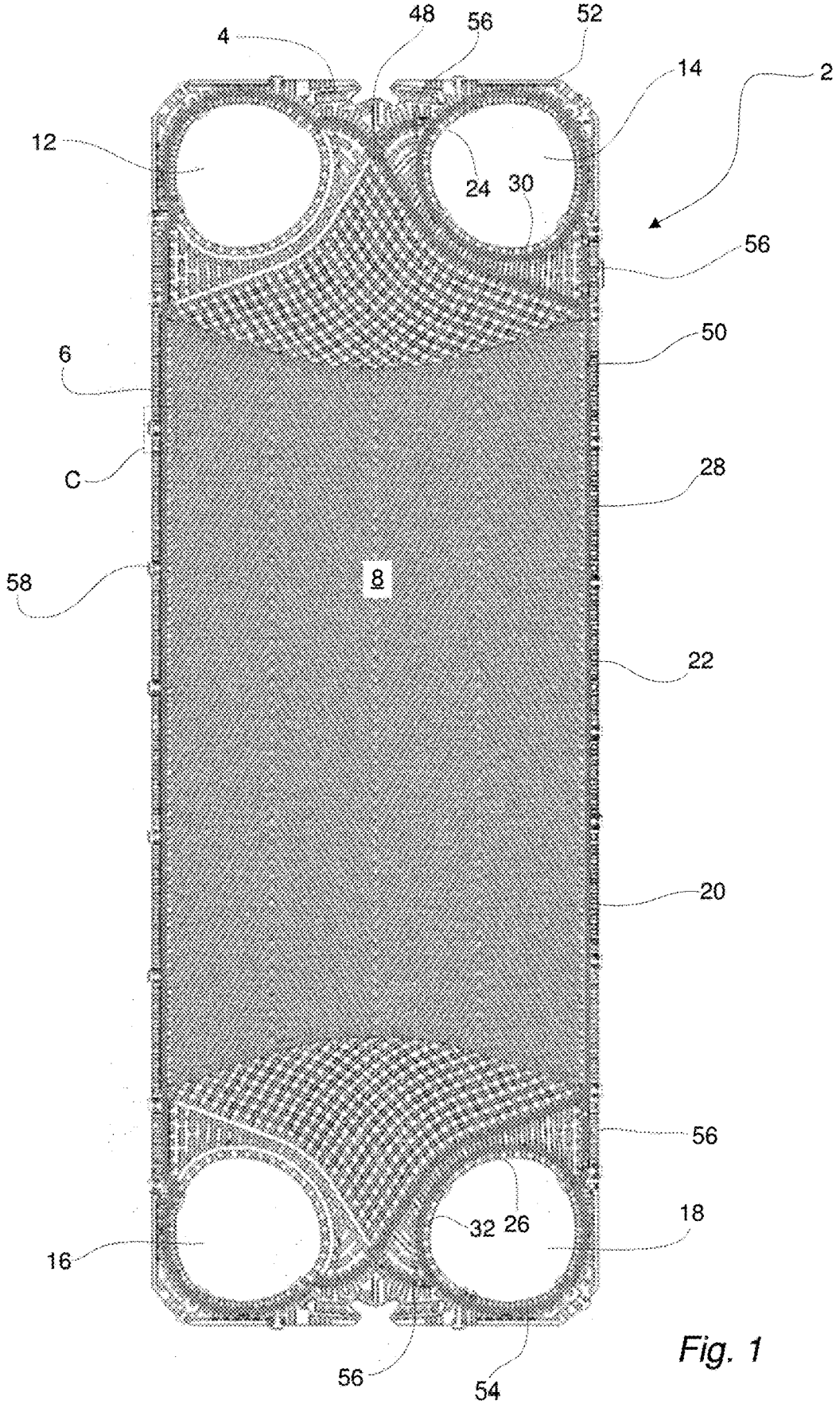
FIG. 1 is a plan view of an assembly comprising a heat transfer plate and a gasket arrangement.
Figure 2:
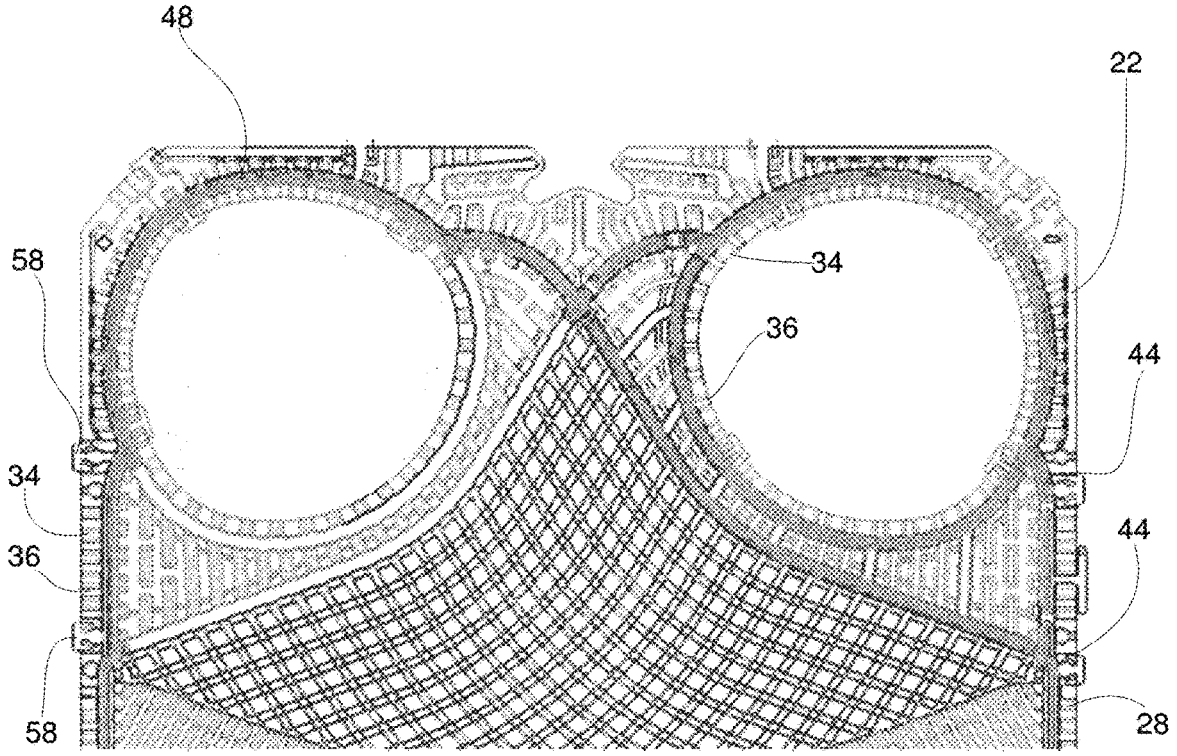
FIG. 2 is a partial enlargement of the assembly of FIG. 1.
Figure 3:
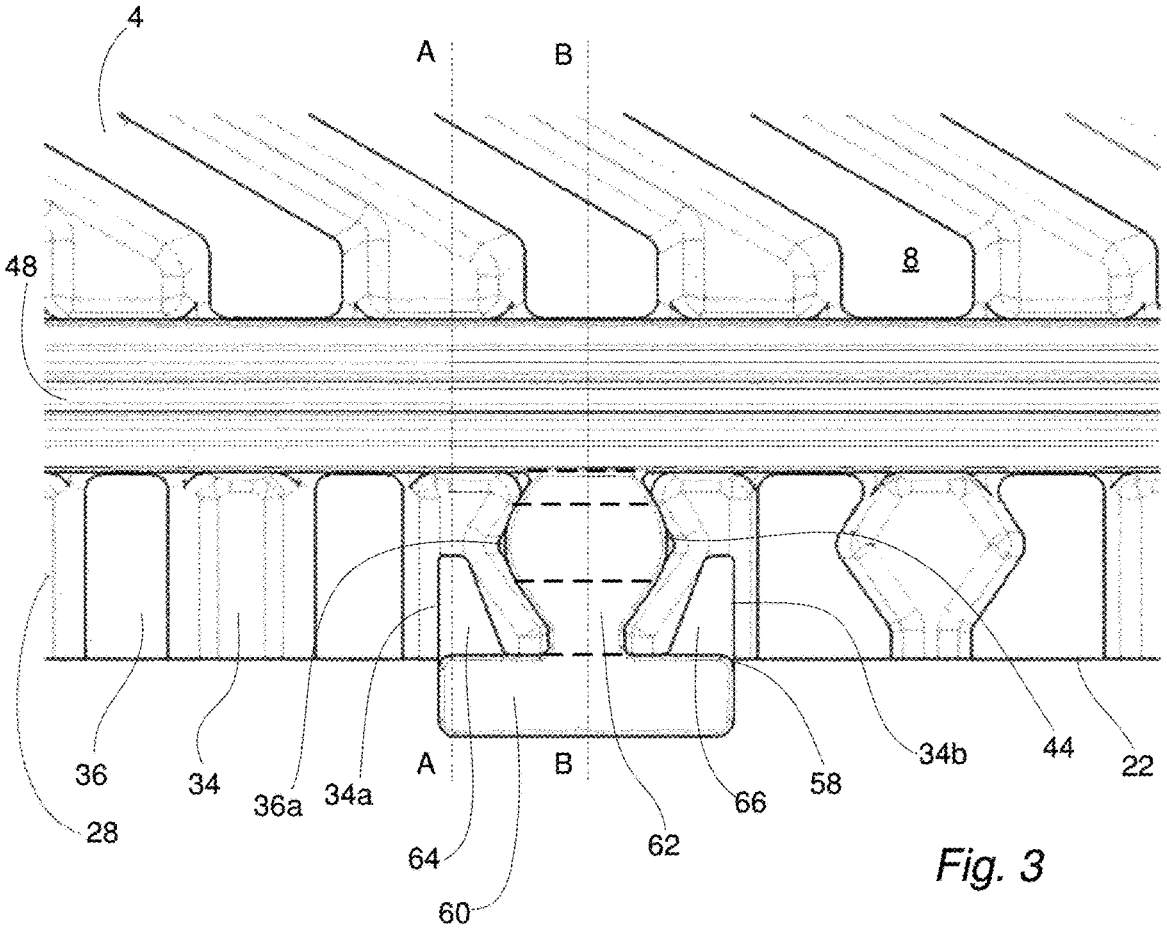
FIG. 3 is a partial further enlargement of the assembly of FIG. 1.

With reference to FIGS. 1-5, an assembly 2 comprising a heat transfer plate 4 and a gasket arrangement 6, is shown. FIG. 2 shows an enlargement of an upper part of the assembly 2 while FIG. 3 shows an enlargement of the area enclosed by the dashed rectangle C in FIG. 1.

Figure 4:
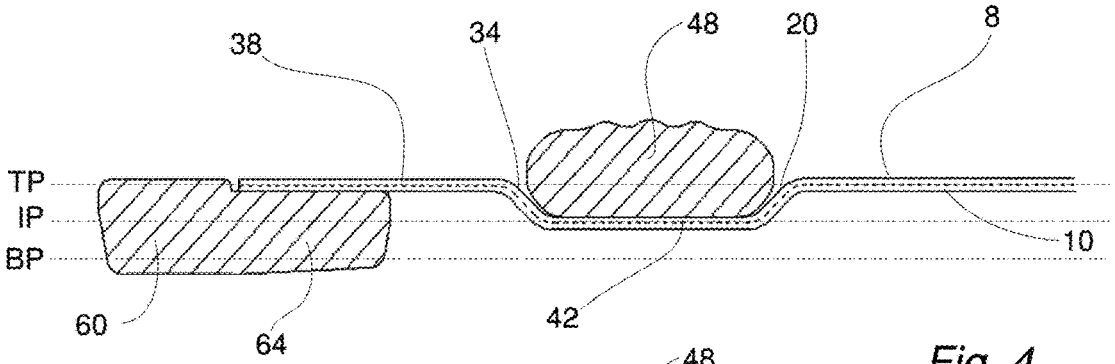
FIG. 4 schematically illustrates a cross section along line A-A in FIG. 3, FIG. 5 schematically illustrates a cross section along line B-B in FIG. 3, FIG. 6 corresponds to FIG. 3 but illustrates the heat transfer plate only.
Figure 5:
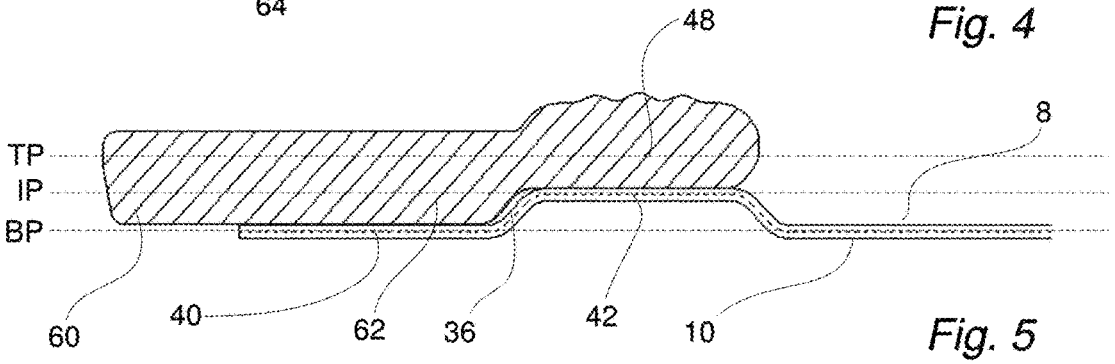
Figure 6:
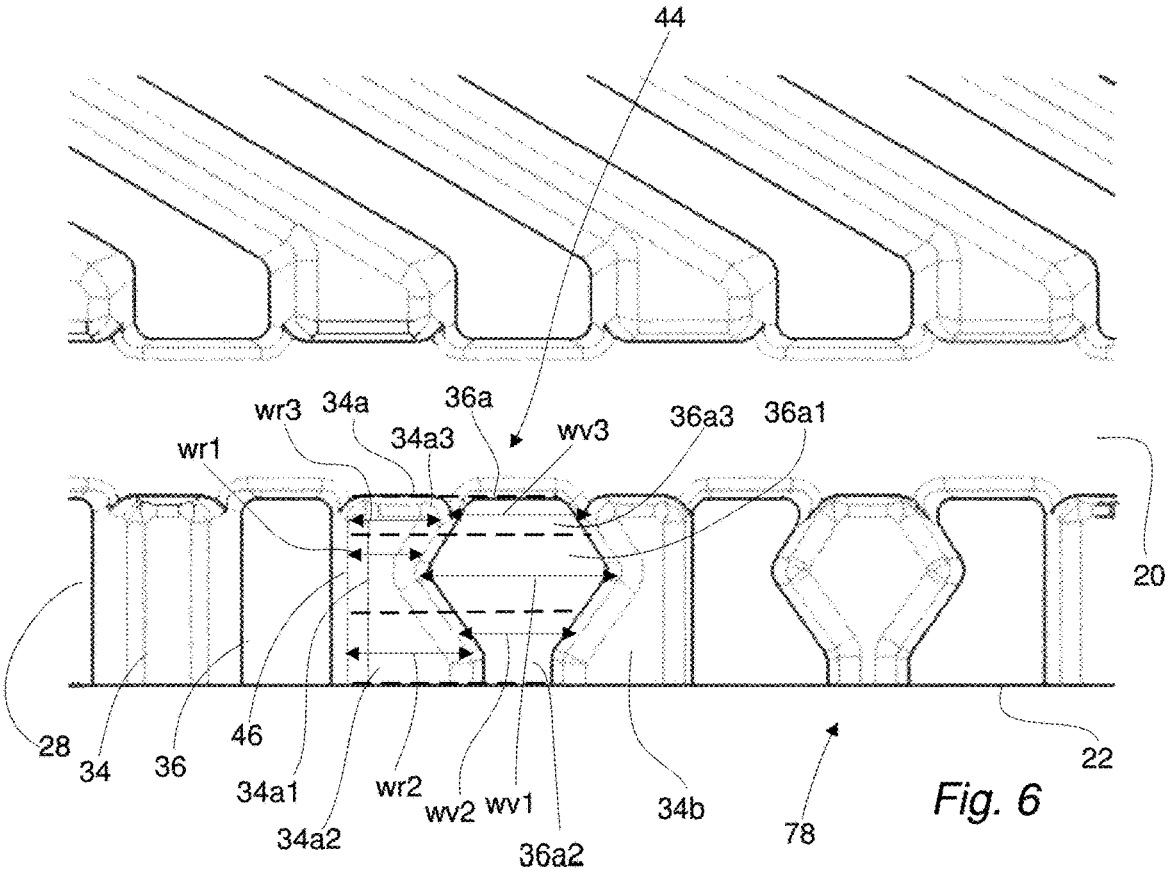

The heat transfer plate 4, which is separately illustrated in FIG. 6 and of which a first side 8 is visible in FIGS. 1-3 and 6, and an opposite second side 10 is illustrated in FIGS. 4 and 5, is an essentially rectangular sheet of stainless steel provided with a number of port holes 12, 14, 16 and 18, and pressed with specific patterns within different areas of the heat transfer plate. Pressed into the first side 8 of the heat transfer plate 4 is also a gasket groove 20 extending along an outer plate edge 22 to enclose the port holes 12, 14, 16 and 18, and completely along two inner plate edges 24 and 26 defining two of the port holes 14 and 18, respectively, to separately enclose these. Further, the gaskets groove 20 extends twice "diagonally" across the heat transfer plate so as to further enclose the port holes 14 and 18. An outer edge portion 28 of the heat transfer plate 4, extending between the outer plate edge 22 and the gasket groove 20, and inner edge portions 30 and 32 of the heat transfer plate 4, extending between the inner plate edge 24 and the gasket groove 20, and between the inner plate edge 26 and the gasket groove 20, respectively, are corrugated so as to comprise alternately arranged ridges 34 and valleys 36 (see FIG. 2 and FIGS. 3 and 6 for the outer edge portion 28). Ridges and valleys as seen from one side of the heat transfer plate 4 are valleys and ridges, respectively, as seen from the other side of the heat transfer plate 4. Obviously, also the portholes portholes 12 and 16 are enclosed by a respective similar corrugated inner edge portion.

As illustrated in FIGS. 4 and 5, a respective top portion 38 of the ridges 34 extend in an imaginary top plane TP while a respective bottom portion 40 of the valleys 36 extend in an imaginary bottom plane BP. A bottom 42 of the gasket groove 20 extend in an imaginary intermediate plane IP, which here extends between the top and bottom planes TP and BP. The intermediate plane IP may have different locations in different embodiments of the invention. In the embodiment illustrated in the drawings, the intermediate plane IP is, along a major part of gasket groove 20, arranged half way between the top and bottom planes TP and BP. In an exemplary alternative embodiment, the intermediate plane IP may instead, along a major part of the gasket groove 20, coincide with the bottom plane BP.

As is clear from especially FIGS. 4-6, the ridges 34 are closed towards the gasket groove 20 and arranged to provide gasket support, while the valleys 36 are open towards the gasket groove 20, here partly open since the bottom 42 of the gasket groove 20 extends above the bottom portions 40 of the valleys 36.

With reference especially to FIG. 2, the outer edge portion 28 of the heat transfer plate 4 comprises a plurality of outer gasket fastening areas 44 distributed along the outer plate edge 22. At least some of the gasket fastening areas 44 are designed according to the present invention. For the sake of completeness it should be said that also the inner edge portions of the heat transfer plate 4 comprise a plurality of inner gasket fastening areas distributed around the portholes 12, 14, 16 and 18. However, these are conventionally designed and will not be further described herein.

One of the gasket fastening areas 44 designed according to the present invention is illustrated in more detail in FIG. 6. It comprises a first valley 36*a* of the valleys 36 and first and second ridges 34*a* and 34*b* of the ridges 34, the first and second ridges 34*a* and 34*b* being arranged on opposite sides of the first valley 36*a*. The majority of the ridges 34 and valleys 36 within the outer edge portion 28 of the heat transfer plate 4 are designed like the left most ridges and valleys 34 and 36 in FIG. 6, i.e. they have a constant width along essentially their entire longitudinal extension, the width being measured parallel to a longitudinal or length extension of the gasket groove 20. However, this is not the case for the first valley 36*a* and the first and second ridges 34*a* and 34*b* of the gasket fastening area 44.

The first valley 36*a*, which has a symmetry axis extending perpendicular to the outer edge 22, comprises a first portion 36*a*1, a second portion 36*a*2 and a third portion 36*a*3. The second portion 36*a*2 borders on the outer edge 22 of the heat transfer plate 4, the third portion 36*a*3 borders on the gasket groove 20 of the heat transfer plate 4, and the first portion 36*a*1 is arranged between the second and third portions 36*a*2 and 36*a*3. In FIG. 6 the borders of the first, second and third portions 36*a*1, 36*a*2 and 36*a*3 are illustrated with dashed lines. The first, second and third portions 36*a*1, 36*a*2 and 36*a*3 have a width wv1, wv2 and wv3, respectively, which are all varying. The second and third widths wv2 and wv3 are both smaller than the first width wv1. An inner sub portion of the second portion 36*a*2, which is bordering on the first portion 36*a*1, is tapered in a direction towards the outer edge 22 of the heat transfer plate 4, while an outer sub portion of the second portion 36*a*2, which is bordering on the outer edge 22, has an essentially constant width. The third portion 36*a*3 is tapered in a direction towards the gasket groove 20 of the heat transfer plate 4.

Further, the first ridge 34*a* comprises a first portion 34*a*1, a second portion 34*a*2 and a third portion 34*a*3. The second portion 34*a*2 borders on the outer edge 22 of the heat transfer plate 4, the third portion 34*a*3 borders on the gasket groove 20 of the heat transfer plate 4, and the first portion 34*a*2 is arranged between the second and third portions 34*a*2 and 34*a*3. In FIG. 6 the borders of the first, second and third portions 34*a*1, 34*a*2 and 34*a*3 are illustrated with dashed lines. The first, second and third portions 34*a*1, 34*a*2 and 34*a*3 have a width wr1, wr2 and wr3, respectively, which are all varying. The second and third widths wr2 and wr3 are both larger than the first width wr1. An inner sub portion of the second portion 34*a*2, which is bordering on the first portion 34*a*1, is tapered in a direction towards the gasket groove 20 of the heat transfer plate 4, while an outer sub portion of the second portion 34*a*2, which is bordering on the outer edge 22, has an essentially constant width. The third portion 34*a*3 is tapered in a direction towards the outer edge 22 of the heat transfer plate 4. The tapering of the second and third portions 34*a*2 and 34*a*3 of the first ridge 34*a* is achieved by an angled inner longitudinal side of the first ridge 34*a*. An outer longitudinal side 46 of the first ridge 34*a* is essentially straight and extends perpendicular to the outer edge 22 of the heat transfer plate 4.

As is clear from FIG. 6, the second ridge 34*b* of the gasket fastening area 44 is designed in a corresponding way as the first ridge 34*a*.

With reference initially to FIGS. 1 and 2, the gasket arrangement 6 comprises a rubber gasket 48, which in turn comprises an annular field portion 50, two annular ring portions 52 and 54 and bridges 56 connecting the ring portions 52 and 54 to the field portion 50. The gasket arrangement 6 further comprises a plurality of rubber attachment means 58 integrally formed with the gasket 48. The attachment means 58 are distributed along an outer side of the field portion 50 of the gasket 48. At least some of the attachment means 58 are designed according to the present invention. For the sake of completeness it should be said that the gasket arrangement 6 comprises attachment means also along an inner side of the ring portions 52 and 54 and an inner side of the field portion 50. However, these are conventionally designed and will not be further described herein.

Figure 7:
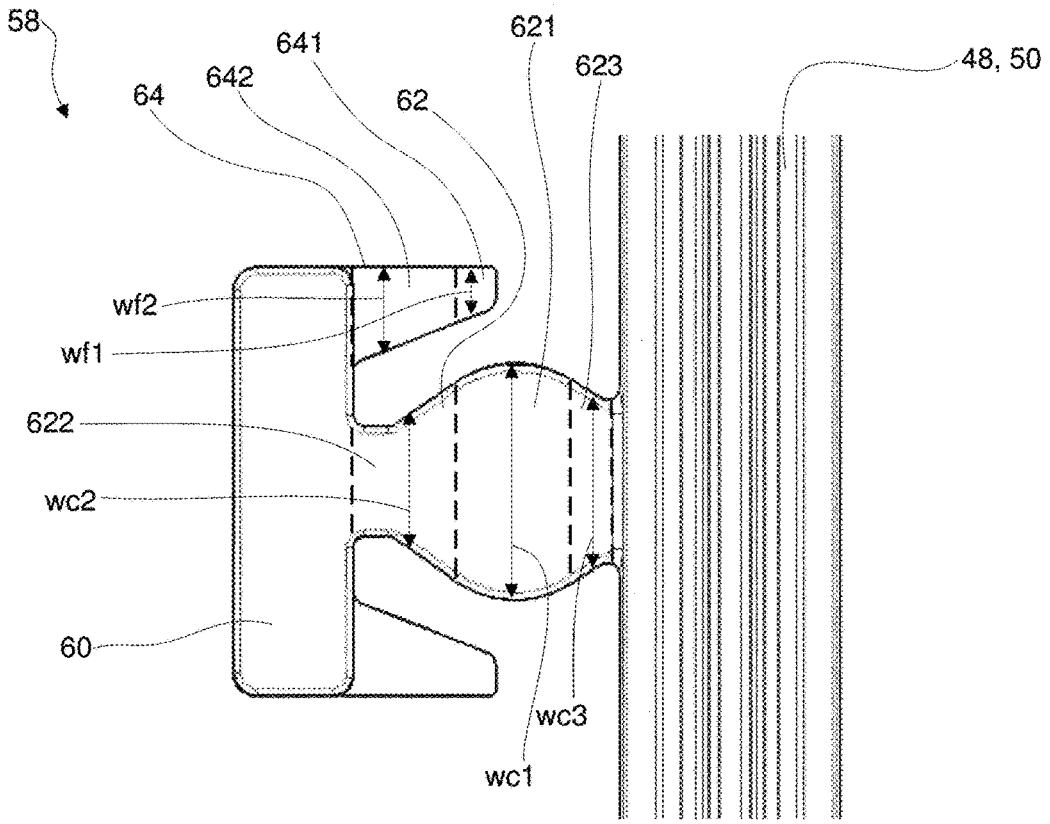
FIG. 7 illustrates a plan view of an attachment means of the gasket arrangement in FIG. 1.
Figure 8:
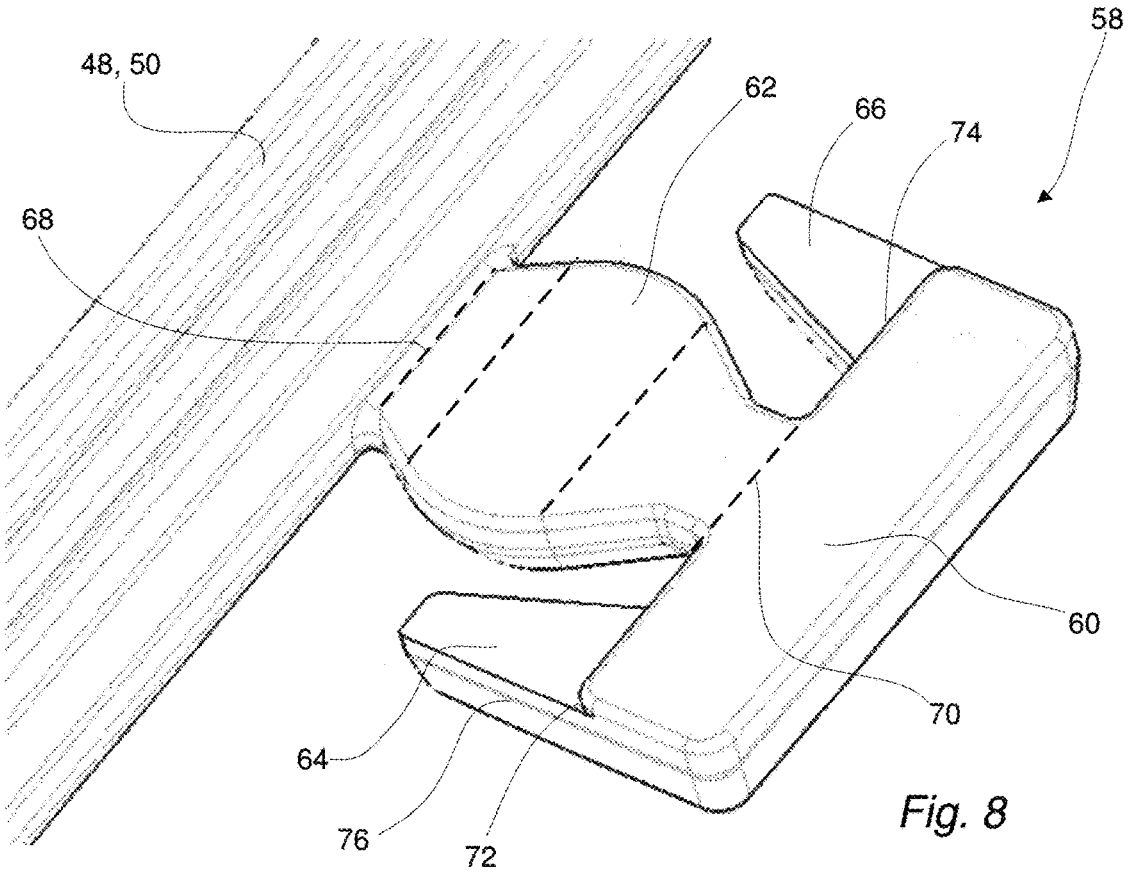
FIG. 8 illustrates a perspective view of the attachment means in FIG. 7.

One of the attachment means 58 designed according to the present invention is illustrated in more detail in FIGS. 7 and 8. It comprises an elongate bridge 60, a connection member 62, a first finger 64 and a second finger 66. The bridge 60 longitudinally extends essentially parallel to the gasket 48 at a distance therefrom. The connection member 62 longitudinally extends essentially perpendicular to the bridge 60 and from a center thereof to connect the bridge 60 to the gasket 48. More particularly, a first connection part 68, in the form of an end, of the connection member 62 is connected to the gasket 48, while a second connection part 70, in the form of another end, of the connection member 62 is connected to the bridge 60. The first and second fingers 64 and 66 longitudinally extend essentially perpendicular to the bridge 60 and from a respective end portion thereof, i.e. on opposite sides of the connection member 62, towards the gasket 48. More particularly, a connection part 72, in the form of an end, of the first finger 64 is connected to the bridge 60, while another end of the first finger 64 is free and arranged at a distance from the gasket 48. Similarly, a connection part 74, in the form of an end, of the second finger 66 is connected to the bridge 60, while another end of the second finger 66 is free and arranged at a distance from the gasket 48.

The connection member 62, which has a symmetry axis extending perpendicular to bridge 60 and through a center thereof, comprises a first portion 621, a second portion 622 and a third portion 623. The second portion 622 borders on the bridge 60 of the attachment means 58, the third portion 623 borders on the gasket 48, and the first portion 621 is arranged between the second and third portions 622 and 623. In FIGS. 7 and 8 the borders of the first, second and third portions 621, 622 and 623 are illustrated with dashed lines. The width of the attachment means 58 and its components are measured parallel to a longitudinal or length extension of the gasket 48. The first, second and third portions 621, 622 and 623 have a width wc1, wc2 and wc3, respectively, which are all varying. The second and third widths wc2 and wc3 are both smaller than the first width wc1. An inner sub portion of the second portion 622, which is bordering on the first portion 621, is tapered in a direction towards the bridge 60 of the attachment means 58, while an outer sub portion of the second portion 622, which is bordering on the bridge 60, has an essentially constant width. The third portion 623 is tapered in a direction towards the gasket 48.

Further, the first finger 64 comprises a first portion 641 and a second portion 642. The second portion 642 borders on the bridge 60 of the attachment means 58, and the first portion 641 is arranged between the bridge 60 and the gasket 48. In FIGS. 7 and 8 the borders of the first and second portions 641 and 642 are illustrated with dashed lines. The first and second portions 641 and 642 have a width wf1 and wf2, respectively, which are both varying. The second width wf2 is larger than the first width wf1. The first and second portions 641 and 642 are tapered in a direction away from the bridge 60. The tapering is achieved by an inner longitudinal side of the first finger 64 which is non-perpendicular to the longitudinal or length extension of the bridge 60. An outer longitudinal side 76 of the first finger 64 is essentially straight and extends perpendicular to the longitudinal extension of the bridge 60. Further, as illustrated in FIG. 8, and also FIG. 4, the first finger 64 has a thickness which is smaller than a thickness of the bridge 60, the thicknesses being measured perpendicular to the longitudinal or length extension of the gasket 48. The connection member 62 of the attachment means 58 has a thickness that is equal to the thickness of the bridge 60.

As is clear from FIGS. 7 and 8, the second finger 66 of the attachment means 58 is designed in a corresponding way as the first finger 64.

The gasket groove 20 of the heat transfer plate 4 is arranged to accommodate the gasket 48, as is illustrated in FIG. 1. Further, the gasket fastening areas of the heat transfer plate 4, are arranged to cooperate with the attachment means of the gasket arrangement 6 to fasten the gasket 48 to the heat transfer plate 4. The cooperation between one of the gasket fastening areas 44 according to the invention and one of the attachment means 58 according to the invention is illustrated especially in FIGS. 3-5. It should be said that the heat transfer plate 4, in the figures and for illustrative purposes, is transparently illustrated within the gasket fastening areas.

With special reference to FIG. 3, when the attachment means 58 engages properly with the gasket fastening area 44, the connection member 62 engages with the first side 8 of the heat transfer plate 4 while the first and second fingers 64 and 66 engage with the second side 10 of the heat transfer plate 4. More particularly, the connection member 62 is received in the first valley 36*a* while the first and second fingers 64 and 66 are received in valleys defined by the first and second ridges 34*a* and 34*b*, respectively. Further, the bridge 60 of the attachment means 58 extends outside the heat transfer plate 4 parallel to the outer edge 22 thereof. The configurations of the connection member 62 of the attachment means 58 and the first valley 36*a* of the gasket fastening area 44 are complementary such that the connection member 62 tightly fits into, and essentially fills up, the entire first valley 36*a*. Due to the varying widths of the connection member 62 and the first valley 36*a* they "interlock" such that the attachment means 58 is prevented from sliding in a direction parallel to the extension plane of the heat transfer plate 4, especially perpendicular to the outer edge 22 of the heat transfer plate 4. Thereby, a reliable fastening of the gasket 48 to the heat transfer plate 4 is achieved.

A gasketed plate heat exchanger may comprise a compressed stack of heat transfer plates 4 and a gasket arrangement 6 arranged between each two adjacent ones of the heat transfer plates 4. With reference to the Background Art section, if the heat transfer plates 4 are to be arranged "rotated" in relation to each other, the gasket arrangements 6 are arranged on, and secured to, the first sides 8 of the heat transfer plates 4 as above described. Then, the heat transfer plates 4, with gasket arrangements 6, are stacked on top of each other, back to front, with every other heat transfer plate 4 turned upside down in relation to the rest of the heat transfer plates. On the other hand, if the heat transfer plates 4 are to be arranged "flipped" in relation to each other, the gasket arrangements 6 are arranged on, and secured to, the first sides 8 of every second one of the heat transfer plates 4, and the second sides 10 of the rest of the heat transfer plates 4. Then, the heat transfer plates 4, with gasket arrangements 6, are stacked on top of each other, back to back and front to front, with every other heat transfer 4 plate turned upside down in relation to the rest of the heat transfer plates. To enable gasket fastening also on the second sides 10 of the heat transfer plates 4, the edge portions 28 of the heat transfer plates 4 also comprises "inverted" gasket fastening areas 78, as illustrated most clearly in FIG. 6.

Figure 9:
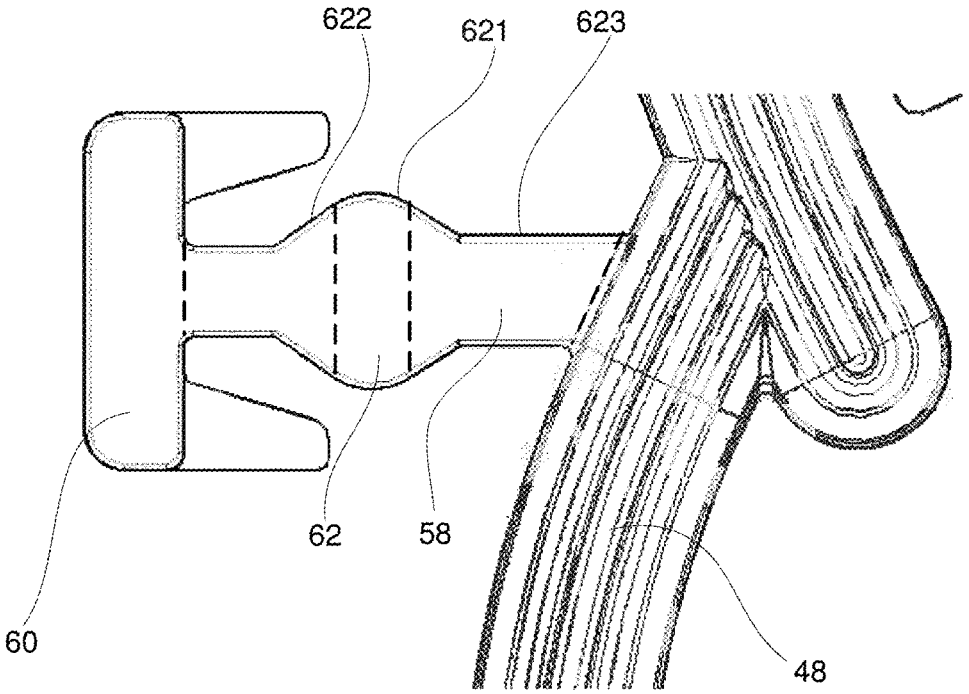
FIG. 9 illustrates a plan view of another attachment means of the gasket arrangement in FIG. 1.

FIG. 9 illustrate another attachment means 58 of the gasket arrangement 6, which is also designed according to the invention. The attachment means in FIG. 9 is similar to the attachment means illustrated in the rest on the figures, and the above description is applicable to also to the attachment means in FIG. 9 with the following exception: the bridge 60 does not longitudinally extend parallel to the gasket 48, the connection member 62 has no symmetry axis, and an outer sub portion of the third portion 623 of the connection member 62, which is bordering on the first portion 621 is tapered in a direction towards the gasket 48 while an inner sub portion of the third portion 623 of the connection member 62, which is bordering on the gasket 48, has an essentially constant width.

The above described embodiments of the present invention should only be seen as examples. A person skilled in the art realizes that the embodiments discussed can be varied in a number of ways without deviating from the inventive conception.

As an example, the connection member and the first and second fingers of the attachment means, and thus the first valley and the first and second ridges of the gasket fastening area need not be partly or completely tapered to achieve the varying widths thereof. For example, the width variation may be more abrupt and instantaneous and take place step wise instead of gradually. In line therewith, one or more of the above referenced first, second and third widths may be constant and not varying. Thus, also the fingers may have a constant width along a part/parts of their lengths.

As another example, the fingers and/or the connection member need not extend parallel to each other and/or perpendicularly to the bridge. Consequently, the first valley and the first and second ridges need not longitudinally extend parallel to each other and perpendicular to the outer plate edge.

The above described heat transfer plate has the inventive gasket fastening areas arranged along an outer plate edge and along two opposing longsides of the heat transfer plate. Consequently, the above described gasket arrangement has the inventive attachment means arranged along two opposing longsides of the field portion of the gasket, projecting from an outer side thereof. Naturally, the inventive gasket fastening areas could also/instead be arranged along two opposing short sides of the heat transfer plate, and/or along an inner plate edge, i.e. around a porthole of the heat transfer plate. Consequently, the inventive attachment means could also/instead be arranged along two opposing shortsides of the field portion of the gasket, and/or along a ring portion of the gasket, projecting from an inner side thereof.

The inventive attachment means could comprise more than one connection member arranged to connect the bridge of the attachment means and the gasket, and more than two fingers arranged to extend from the bridge of the attachment means towards the gasket. The heat transfer plate could have gasket fastening areas designed for cooperation with such an attachment means.

The attachment means need not be designed in such a way that the bridge thereof is arranged to be positioned outside the heat transfer plate when the attachment means engage properly with the heat transfer plate. Instead, the bridge could be designed to be at least partly positioned within the heat transfer plate, and possibly engage with the first and/or the second side of the heat transfer plate, when the attachment means engage properly with the heat transfer plate. The heat transfer plate could have gasket fastening areas designed for cooperation with such an attachment means.

The connection member of the above attachment means extend from the bridge to the gasket but it could instead extend beyond the bridge and/or the gasket. Similarly, the fingers could extend beyond the bridge and/or the gasket. The heat transfer plate could have gasket fastening areas designed for cooperation with such an attachment means.

The gasket and the attachment means need not be integrally formed but could be two separate but connectable parts. Further, the gasket and attachment means need not be made of rubber but can be made of any suitable material. Further, the gasket and attachment means need not be of the same material.

The heat transfer plate need not be made of stainless steel but could be made of any suitable material, such as titanium or aluminium.

Finally, the present invention could be used in connection with other types of plate heat exchangers than purely gasketed ones, e.g. plate heat exchangers comprising permanently joined heat transfer plates.

It should be stressed that the attributes first, second, third, etc. is used herein just to distinguish between species of the same kind and not to express any kind of mutual order between the species.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. An attachment device for fastening a gasket to a heat transfer plate, comprising a connection member having a bottom surface arranged to face toward a surface of the heat transfer plate, a first finger, a second finger and a bridge, a first connection part of the connection member being arranged to engage with the gasket, a second connection part of the connection member engaging with the bridge, a connection part of the first finger engaging with the bridge, a connection part of the second finger engaging with the bridge, the first and second fingers being arranged to extend from the bridge towards the gasket, and the connection member extending between the first and second fingers, the connection member comprising a first portion with a first width at the bottom surface of the connection member and a second portion with a second width at the bottom surface of the connection member, the second portion being arranged closer to the bridge than the first portion, and the second width being smaller than the first width.

2. An attachment device according to claim 1, wherein the second portion of the connection member is tapered in a direction towards the bridge along at least part of its length.

3. An attachment device according to claim 1, wherein the connection member further comprises a third portion with a third width, the first portion of the connection member being arranged between the second and third portions of the connection member, and the third width being smaller than the first width.

4. An attachment device according to claim 3, wherein the third portion of the connection member is tapered in a direction away from the bridge along at least a part of its length.

5. An attachment device according to claim 1, wherein the first finger comprises a first portion with a first width and a second portion with a second width, the second portion being arranged closer to the bridge than the first portion, and the first width being smaller than the second width.

6. An attachment device according to claim 5, wherein the second portion of the first finger is tapered in a direction away from the bridge along at least part of its length.

7. An attachment device according to claim 1, wherein an outer longitudinal side of the first finger is essentially straight and extends essentially perpendicular in relation to a length extension of the bridge.

8. An attachment device according to claim 1, wherein a thickness of the bridge is larger than a thickness of the first finger.

9. A heat transfer plate comprising, on a first side thereof, a gasket groove extending along an edge of the heat transfer plate, an edge portion of the heat transfer plate extending between the edge and the gasket groove and being corrugated so as to comprise alternately arranged ridges and valleys as seen from the first side of the heat transfer plate, the ridges comprising a first ridge, a second ridge, a third ridge and a fourth ridge, the first and second ridges being positioned between the third and fourth ridges, the first ridge being positioned immediately adjacent the third ridge, the second ridge being positioned immediately adjacent the fourth ridge, the first ridge having a top that lies in a plane, each of the second, third and fourth ridges having a top that also lies in the plane, the edge portion comprising a gasket fastening area arranged to engage with an attachment device for fastening a gasket in the gasket groove, the gasket fastening area comprising a first one of the valleys and the first and second ones of the ridges, the first and second ridges being arranged on opposite sides of the first valley and having sides that are spaced apart by distances measured parallel to the edge, the first valley comprising a first portion with a first width measured as the distance between first parts of the sides of the first and second ridges and a second portion with a second width measured as the distance between second parts of the sides of the first and second ridges, the second portion being arranged closer to the edge than the first portion, and the second width being smaller than the first width.

10. A heat transfer plate according to claim 9, wherein the second portion of the first valley is tapered in a direction towards the edge along at least part of its length.

11. A heat transfer plate according to claim 9, wherein the first valley further comprises a third portion with a third width measured as the distance between third parts of the sides of the first and second ridges, the first portion of the first valley being arranged between the second and third portions of the first valley, and the third width being smaller than the first width.

12. A heat transfer plate according to claim 11, wherein the third portion of the first valley is tapered in a direction away from the edge along at least a part of its length.

13. A heat transfer plate according to claim 9, wherein the first ridge comprises a first portion with a first width and a second portion with a second width, the second portion being arranged closer to the edge than the first portion, and the first width being smaller than the second width.

14. A heat transfer plate according to claim 13, wherein the second portion of the first ridge is tapered in a direction away from the edge along at least part of its length.

15. A heat transfer plate according to claim 9, wherein an outer longitudinal side of the first ridge is essentially straight and extends essentially perpendicular in relation to the edge of the heat transfer plate.

16. An attachment device for fastening a gasket to a heat transfer plate, comprising a connection member, a first finger, a second finger and a bridge, a first connection part of the connection member located at a first end of the connection member being arranged to engage with the gasket, a second connection part of the connection member located at a second end of the connection member engaging with the bridge, the connection member having opposite sides that extend from the first end of the connection member to the second end of the connection member, a connection part of the first finger engaging with the bridge, a connection part of the second finger engaging with the bridge, the first and second fingers being arranged to extend from the bridge towards the gasket, and the connection member extending between the first and second fingers, the connection member comprising a first portion with a first width that is a distance between outermost portions of the opposite sides of the connection member in the first portion of the connection member, the connection member also comprising a second portion with a second width that is the distance between outermost portions of the opposite sides of the connection member in the second portion of the connection member, the second portion being arranged closer to the bridge than the first portion, and the second width being smaller than the first width.

17. An attachment device according to claim 16, wherein the bridge includes a surface arranged to face toward the gasket, the second portion of the connection member including a tapered part that tapers in a direction towards the bridge, the tapered part being located entirely between the surface of the bridge and the first end of the connection member.

18. An attachment device according to claim 16, wherein the connection member further comprises a third portion that tapers toward the first end of the connection member, the third portion of the connection member having a third width that is the distance between outermost portions of the opposite sides of the connection member in the third portion of the connection member, the first portion of the connection member being arranged between the second and third portions of the connection member, and the third width being smaller than the first width.

19. An attachment device according to claim 16, wherein the connection member further comprises a third portion, the first portion of the connection member being positioned between the second and third portions of the connection member, the first width in the first portion of the connection member varying along at least a part of the first portion of the connection member.

* * * * *